US006205366B1

(12) United States Patent
Tang et al.

(10) Patent No.: US 6,205,366 B1
(45) **Date of Patent: *Mar. 20, 2001**

(54) METHOD OF APPLYING THE RADIAL RETURN METHOD TO THE ANISOTROPIC HARDENING RULE OF PLASTICITY TO SHEET METAL FORMING PROCESSES

(75) Inventors: Sing Chih Tang, Plymouth; Perry Robinson MacNeille, Lathrup Village; Zhiyong Cedric Xia, Canton, all of MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/396,095

(22) Filed: Sep. 14, 1999

(51) Int. Cl.[7] ..... G06F 19/00

(52) U.S. Cl. ..... 700/97; 700/34; 700/98; 700/127; 700/145; 700/146; 700/15; 700/206; 702/34; 702/42

(58) Field of Search ..... 700/98, 97, 145, 700/146, 34, 127, 150, 206; 702/34, 42

(56) References Cited

U.S. PATENT DOCUMENTS

| | | | | |
|---|---|---|---|---|
| Re. 36,602 | * | 3/2000 | Sebastian et al. | 700/97 |
| 5,168,169 | | 12/1992 | Brewer, Jr. et al. | 198/690.1 |
| 5,341,303 | | 8/1994 | Foroudastan et al. | 700/145 |
| 5,528,504 | | 6/1996 | Brewer | 700/97 |
| 5,561,754 | * | 10/1996 | Oliver et al. | 345/441 |
| 5,822,206 | * | 10/1998 | Sebastian et al. | 700/97 |
| 6,009,378 | * | 12/1999 | Tang et al. | 702/34 |

OTHER PUBLICATIONS

Hsu et al., Process controller design for sheet metal forming, American Control Conference, 1999. Proceedings of the 1999, vol. 1, pp. 192–196 vol. 1.*

Manabe et al., Intelligent design architecture for process control of deep–drawing, Intelligent Processing and Manufacturing of Materials, 1999. IPMM '99. Proceedings of the Second International Conference on vol. 1, 1999, pp. 571–576 vol. 1.*

Menzel et al., Present status of intelligent machines in sheet metal fabricating and forming in Japan, Intelligent Processing and Manufacturing of Materials, 1999. IPMM '99. Proceedings of the Second International Conference on vol. 2, 1999, pp.*

* cited by examiner

*Primary Examiner*—William A. Cuchlinski, Jr.
*Assistant Examiner*—McDieunel Marc
(74) *Attorney, Agent, or Firm*—Jerome Drouillard

(57) ABSTRACT

A method (100) for predicting distortion of a sheet metal during a sheet forming process to form the sheet metal into a part. The method (100) of the present invention is for use with a computer including memory and sheet forming tools. The method (100) comprises applying (104–116) the radial return method to compute the total stress for the anisotropic hardening rule of Mroz. The method (100) of the present invention does not divide a given strain increment into hundreds of subintervals as long as the movement of the center of the active yield surface is along a fixed path. If a break occurs, the given strain increment is divided into a few segments (110).

5 Claims, 3 Drawing Sheets

METHOD OF APPLYING THE RADIAL RETURN METHOD TO THE ANISOTROPIC HARDENING RULE OF PLASTICITY TO SHEET METAL FORMING PROCESSES

BACKGROUND OF THE INVENTION

The present invention relates generally to a method of simulating sheet metal forming processes, and in particular to a method which applies the radial return method to the anisotropic hardening rule of plasticity, according to Mroz, to simulate strain and stress during the sheet metal forming process.

In the stamping industry, shape distortion due to springback from flanging operations is a serious problem. In many cases, manual correction for shape distortion remains the common practice. It is estimated that $100 million dollars is spent each year by North American stamping plants alone to correct shape distortion defects. This concern is even more critical for lightweight materials such as aluminum and high-strength steel. The generation of springback is based on the hardening rule in the mathematical theory of plasticity used in sheet metal forming simulations.

For simplicity, most sheet metal forming simulation codes use the isotropic hardening rule developed by the mathematical theory of plasticity. However, this hardening rule does not produce realistic numerical results when used to analyze cyclic loading and unloading processes, such as those associated with stretching, bending and unbending over a small radius, or straightening an initial wrinkling as happens in a draw forming operation. To establish the incremental stress/strain relationship, the anisotropic hardening theory should be used for a more exact simulation of sheet metal forming processes.

The simplest anisotropic hardening rule is the kinematic rule by Prager and Ziegler. This hardening rule has been used to simulate the Bauschinger effect. However, for complex loading histories, actual material behavior substantially deviates from that predicted by this kinematic hardening rule. In addition, there is no definite method for determining the tangent modulus for a nonlinear hardening material.

The hardening rule proposed by Mroz, "On the description of anisotropic work hardening", J. MECH. PHYS. SOLIDS, Vol. 15, pp. 163–175, 1967, is based on an observation of material fatigue behavior. Mroz's interpretation is more appropriate for studying the influence of complex loading histories on material behavior which cannot be explained by either the isotropic or the kinematic anisotropic hardening rule.

Up to a certain point, the amplitude of the uniaxial stress predicted by Mroz's rule is identical to that predicted by the kinematic hardening rule for the uniaxial stress. However, there is no difficulty in determining the tangent modulus for a nonlinear hardening material for the kinematic hardening rule.

C. Chu in "A three dimensional model of anisotropic hardening in metals and its application to the analysis of sheet metal formability," J. MECH. PHYS. Solids, Vol. 32, pp. 197–212, 1984 extended Mroz's rule to establish a general constitutive equation in terms of the Cartesian tensor for the elastic plastic material in a three dimensional continuum. Unlike the isotropic and kinematic hardening rules, in which a single yield surface is assumed either to expand or translate, respectively, as a result of plastic deformation, Mroz's model introduced the concept of the field of work-hardening moduli which are defined by the configuration of an infinite number of initially concentric yield surfaces in deviatoric stress space.

The general rules governing the configuration change are that yield surfaces must move as rigid bodies with the loading point when it is in contact with them, and that the surfaces cannot pass through one another. Therefore, the surfaces will become mutually tangent at the loading point when it is in contact with them, and that the surfaces cannot pass through one another. As it passes from the elastic into the plastic region, the loading point will first encounter the smallest yield surface, which has a radius $\sqrt{2/3}\,\sigma_0$ wherein $\sigma_0$ is the initial yield stress. This surface will be pushed forward until the next larger surface is reached and then these two surfaces will then move forward together and so on. Each of the yield surfaces has a constant work hardening modulus.

Since a surface is permitted only rigid body motion, its size may be used as a parameter to determine the modulus. When the material is deep into the plastic range and multiple yield surfaces are tangent to one another at the loading point, the instantaneous modulus for continuous loading is the one associated with the largest yield surface in contact. This is the active yield surface. The smaller yield surfaces can become active again whenever unloading and reloading takes place.

The following derives the equations for change-of-yield surface size and central movement. The Von Mises yield criterion in Cartesian coordinate system is used. According to Mroz's rule, the yield function is written as:

$$f=(3/2)(s_{ij}-a_{ij})(s_{ij}-a_{ij})-k^2=0(i,j=1,3) \tag{1}$$

where $s_{ij}$ are the deviatoric components of the Cauchy stress tensor, $a_{ij}$ is the position tensor of the center of the active yield surface, and $\sqrt{2/3}$ k is the radius of this surface. Note that the boldface character denotes a tensor, the index denotes its component and the repeated index means summation. The differential form of the yield function is:

$$(3/2)(s_{ij}-a_{ij})(ds_{ij}-da_{ij})-kdk=0 \tag{2}$$

assuming the yield surface moves along a unit tensor b, the magnitude of da is the increment of the radius of the yield surface. Therefore, $$da_{ij}=\sqrt{2/3}dk\ b_{ij} \tag{3}$$

Substituting this equation into Equation (2) yields $$dk=(3/2)(s_{ij}-a_{ij})ds_{ij}/\bar{k} \tag{4}$$

where $$\bar{k}=k+\sqrt{3/2}(s_{ij}-a_{ij})b_{ij}$$

and Equation (3) becomes $$da_{ij}=\sqrt{3/2}[(s_{mn}-a_{mn})ds_{mn}/k]b_{ij} \tag{5}$$

If the associated flow rule is assumed, the elastic plastic constitutive equation can be derived in a procedure similar to that by means of the isotropic hardening rule.

An example depicting the change of active yield surfaces in a process for initial loading, unloading, reloading, unloading again and then reloading in a multiple-dimensional deviatoric stress component space is illustrated in conjunction with FIG. 1 as follows:

1. Initial and Continuous Loading. The center of the initial yield surface is at the origin O and its radius is $\sqrt{2/3}\,\sigma_0$. One continuously loads to point $A_0$ where the radius of the yield surface is $\sqrt{2/3}k$ as shown in FIG. 1. The unit tensor b in Equation (3) is along $OA_0$. The center of the smallest yield surface with radius $\sqrt{2/3}\,\sigma_0$ moves to $O_1^{(1)}$.

2. Unloading and Reloading. One unloads inside the smallest yield surface with center at $O_1^{(1)}$ and reloads to $A_1$ with the deviatoric stress increment ds. Using this increment and the unit tensor b, one can compute the center $O_1^{(i)}$ of the bigger yield surface and its radius $\sqrt{2/3}k_1$ from Equations (4) and (5). The updated unit tensor b is along $O_1^{(i)}A_1$ and the center of the updated smallest yield surface is along this line and thus can be located at $O_2^{(1)}$ as shown in FIG. 1.

3. Unloading Again and Then Reloading. If one unloads again inside the newest smallest yield surface and reloads into the plastic range again, the center of the active yield surface is along the line $O_1^{(i)}O_2^{(1)}$. This center cannot go beyond $O_1^{(i)}$ as shown in FIG. 1. If it does (a break occurs), the new center will lie on the line $OA_o$. If continuous loading occurs, the center of the active yield surface cannot go beyond O; otherwise, the yield surface with the radius $\sqrt{2/3}k$ will be active (another break occurs) and move to tangent a yield surface with bigger radius than $\sqrt{2/3}k$ and its center still at O.

The hardening rule proposed by Mroz better explores the influence of complex loading histories on material behavior which cannot be explained by either the isotropic or the kinematic hardening rule. However, Mroz's model can accurately predict springback for nonlinear hardening materials. The linear elastic model underestimates the amount of springback, while the isotropic hardening rule makes wrong predictions.

Accordingly, there is a need for a revised approach to the traditional isotropic hardening rule, one that allows a more accurate simulation of forming processes and particularly the prediction of springback for nonlinear materials.

SUMMARY OF THE INVENTION

It is an object of the present invention to provide an improved method for the analysis of forming processes of sheet metal.

It is another object of the present invention to provide a method for the analysis of sheet metal forming processes, such as the prediction of springback, for automotive sheet metal parts.

It is a further object of the present invention to provide a method for the analysis of sheet metal forming processes that applies the radial return method to the anisotropic hardening rule of Mroz.

The present invention is advantageous in that it provides a more accurate and more efficient method of computing stresses than the subinterval method as described in U.S. patent application Ser. No. 08/950,085 in simulation of sheet metal forming processes.

In carrying out the above objects and other objects and features of the present invention, a method is provided for predicting distortion of a sheet metal during a sheet forming process to form the sheet metal into a part. The method of the present invention is for use with a computer including memory and sheet forming tools. The method comprises applying the radial return method to compute the total stress for the anisotropic hardening rule. The met hod of the present invention does not divide a given strain increment into hundreds of subintervals as long as the movement of the center of the active yield surface is along a fixed path.

Another advantage of the present invention is that application of the radial return method according to the present invention allows continuous computation of the total stress. Consequently, yet another advantage of the present invention is the improved accuracy and a significantly faster computing time.

Other objects and advantages of the invention will become apparent upon reading the following detailed description and appended claims, and upon reference to the accompanying drawings.

BRIEF DESCRIPTION OF THE DRAWINGS

For a more complete understanding of this invention, reference should now be had to the embodiments illustrated in greater detail in the accompanying drawings and described below by way of examples of the invention. In the drawings.

DETAILED DESCRIPTION OF A PREFERRED EMBODIMENT

Figure 2:
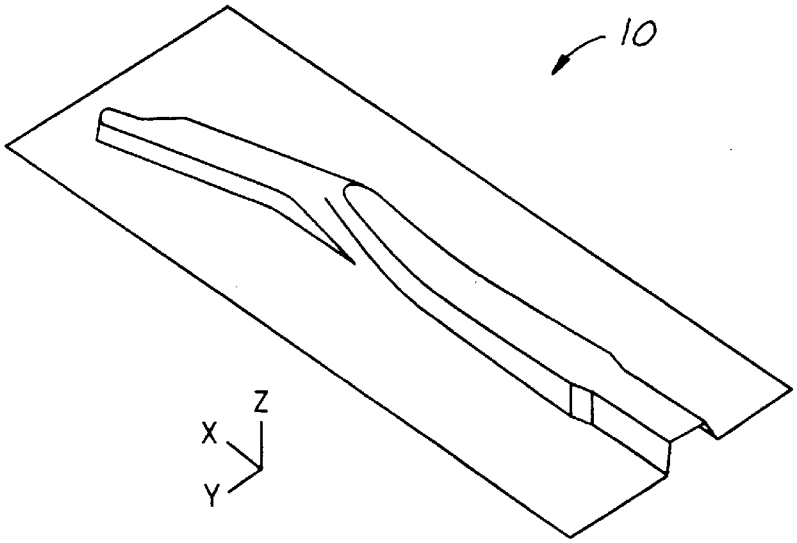
FIG. 2 is a perspective view of a floor center member for an automotive body presented by way of example in applying the method of the present invention.

This invention concerns the application of the radial return method to the anisotropic hardening rule of Mroz in simulation of sheet metal forming processes. FIG. 2 is a perspective view of a floor center member that is formed using a sheet metal forming process.

In sheet metal forming operations, the part being formed conforms closely to the die shape. After being released from the forming tools, its shape changes. This change in shape is referred to as springback. Springback generally refers to the tendency for a member being formed to return to some shape intermediate its original blank shape and that of the tool. Springback is especially severe for aluminum and high strength steel. Compensating for this distortion in shape, the first step is to predict the amount of springback in a part for a given design of forming tools.

To predict springback, which is controlled by stresses at the end of draw die closure, the focus of the prediction accuracy must be shifted to the stress distribution across the entire stamping process. This task presents many more demands than those required for predicting fracture and wrinkling/buckling. Quasi-static analysis with implicit time integration is the most appropriate method for accurately predicting the overall strain and stress distribution across an entire stamped part. In addition, since springback involves unloading caused by the release of the part from stamping tools, it requires a material model with a cyclic stress-strain relationship.

As in the forming analysis, it is necessary to solve a surface contact problem with friction to find the final shape of a part after release from the forming tools. When using the implicit method, the formulation for a surface contact problem involves the material derivatives of the contact forces in terms of the curvatures of the tool surface. Though an iterative process not requiring curvatures can be used, the computation is still very complex.

An approximate method not requiring the solution of a surface contact problem can be handled using springback analysis. From the forming analysis after die closure, the tool pressure and the frictional force acting on the sheet metal part can be computed. Springback can further be computed from the deformed shape of the part by releasing the tool pressure and the frictional force. Applying these forces with equal magnitudes but opposite signs to the deformed part with the appropriate support to eliminate any rigid body motion, makes it possible to compute the additional deformation of the structure due to springback.

A stamped part must be supported to eliminate all three rigid body translations and all three rigid body rotations for a statically determinant structure. The geometric nonlinearity due to a large deformation and the material nonlinearity due to reversed plastic flow in the springback analysis are still considered.

In order to gain a better understanding of the phenomenon behind sheet metal forming processes, it is necessary to analyze the mechanisms at work during the forming process. This effort involves understanding stress distribution as it relates to different forming mechanisms. Based on the simulation, the contour of the sheet metal can be determined to prevent shape distortion defects by modification of the die surface shape.

The complex shapes of the contoured members that are utilized for forming automobile parts are inherently difficult to form. Due to the shapes required by styling and aerodynamics and because of the emphasis on load carrying capability combined with weight efficiency, optimized designs are created, with the use of aluminum and high strength steel. The criticality of design requires that precise forming tolerances be maintained, without sacrificing the fatigue life or strength of the member as a result of the forming process chosen.

Figure 3:
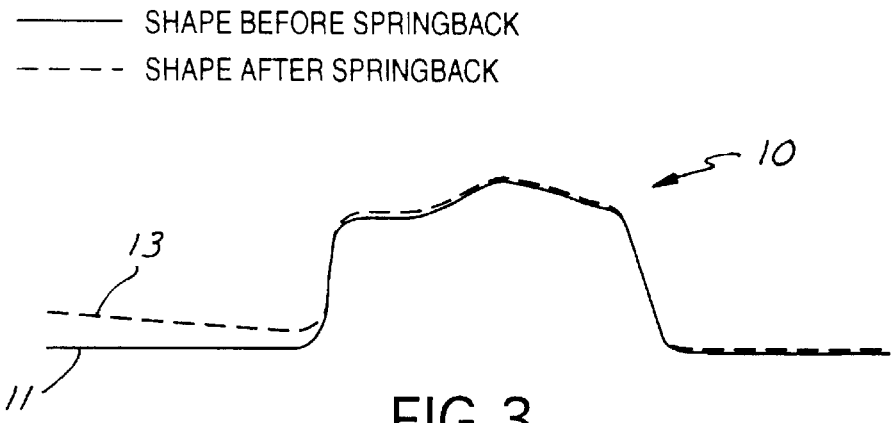
FIG. 3 is a cross-sectional view of an automotive floor center member before and after springback.

Referring to FIG. 2 there is shown a perspective view of one half of a symmetrical floor center 10 member for an automotive body. The part is typically formed in a die whereby the upper die is lowered onto a lower punch with a pressure applied in stages. The die closure and pressure stages, form the contoured automotive body panel 10 or other structure members. FIG. 3 is a cross-sectional view of the floor center member 10 before springback 11, and after springback 13.

Figure 4:
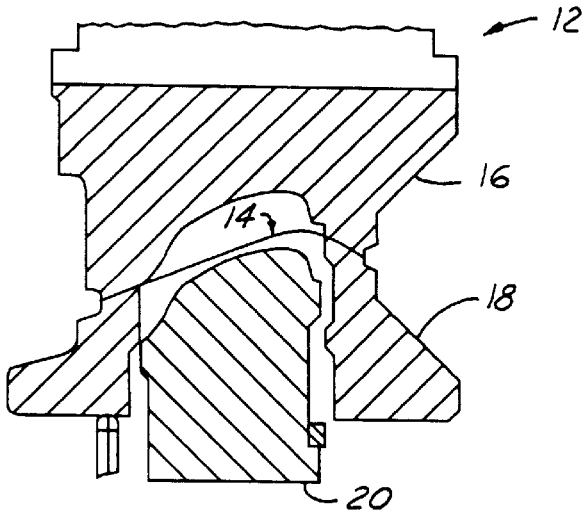
FIG. 4 is a sectional view of a stretch draw die apparatus for an automotive floor center member in the binder wrap stage of the metal forming process.

FIG. 4 shows a cross-sectional view of a stretch draw die apparatus 12 for the automotive body panel in the binder wrap stage. A binder ring is closed and holds the perimeter of a sheet metal blank 14. The upper die 16 is one piece with the upper binder ring, and is lowered onto a lower binder ring 18 which is floating in this stage, setting the binder shape.

Figure 5:
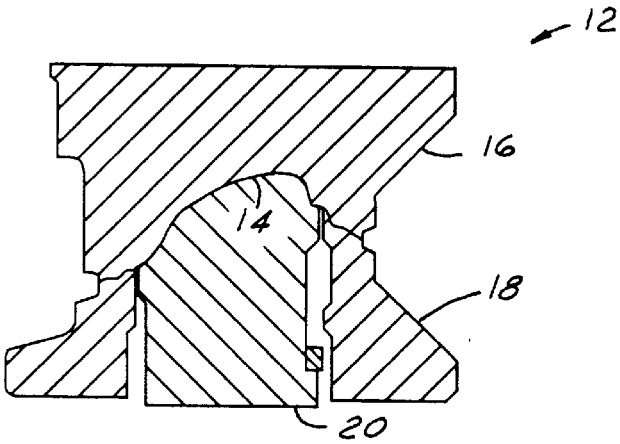
FIG. 5 is a sectional view of a stretch draw die apparatus for an automotive body panel in the die closure stage of the metal forming process.

FIG. 5 is a cross-sectional view of the stretch draw die apparatus 12 in the die closure stage. The lower binder ring 18 together with the upper binder ring and upper die 16 descend to press the sheet metal blank 10 onto a stationary lower punch 20 forming the contoured automotive body panel. Although the drawing FIGS. 3 and 4 illustrate a stretch draw die apparatus, the present invention is equally applicable to other apparatus, such as a die apparatus of a conventional toggle draw.

The modeling of the deformation of sheet metal, under the present invention, is preferably carried out on a computer, such as an IBM RS6000/395 workstation. The computer preferably includes a CPU, a RAM or core memory, disk memory, a display or similar output, and an input means, such as a keyboard. The computer simulates the formation of automobile body panels from sheet metal. Given the material modeling equations of the present invention, the sheet metal deformation after binder wrap is determined. This step is necessary prior to performing die closure analysis, including prediction of sheet metal deformation and stress distribution during die closure analysis, including prediction of sheet metal deformation and stress distribution during die closure.

Surface modeling is achieved utilizing a software preprocessor, which could be written in the C programming language, which transforms CAD surface data input from a designer into a finite element surface model. Typically, the designer creates binder line data and punch/die line data initially utilizing an appropriate CAD program. The line data represents the tool surfaces, such as the tool ridges and the like. Typically, the software preprocessor creates a triangular mesh establishing the connectivity of the tool surface, utilizing a nearest neighbor algorithm which fills in the surface between the points on the lines.

The tool surface triangular mesh is a plurality of interconnected triangles, the vertices of which are referred to as nodal points or nodes. Utilizing the nearest neighbor algorithm will sometimes cause an inconsistency between the connectivity of the original line data and the resulting tool surface mesh, resulting in errors of shape, which are preferably corrected. The tool surface triangular mesh is then provided as an input to the die closure analysis, described in greater detail below, to test for contact between the tool surface and the sheet metal.

The binder wrap shaped finite element model is modified by the software preprocessor. The binder wrap shape is also represented by a triangular mesh. During this modification, the binder wrap finite element model mesh is refined. In other words, the analyst is allowed to alter the nodal positions of the mesh by varying the positions of the nodes. However, the modified nodal positions will still lie on the binder wrap surface, i.e. the surface of the binder wrap will stay the same. It should be appreciated by one of ordinary skill in the art that this modification provides the advantage of allowing the analyst to increase the density of the nodes in particular areas, such as an area of high curvature, to more accurately predict strain concentration associated with the die closure stage of the metal forming process.

The step of modifying the binder wrap finite element model also preferably includes defining the constraining forces due to binder pressure and the draw-bead. The constraining forces due to drawbeads are modeled as an elastic-plastic spring. Still further, binder wrap finite element model modification entails defining the sheet metal material properties, in addition to Young's modulus of elasticity and Poisson's ratio, material parameters of the plastic range, and defining the friction coefficient of the metal and the tool surfaces.

Die closure analysis is performed. In general, the method of the present invention involves solving a sequence of force balancing problems, referred to as load steps, upon the modified binder wrap triangular mesh. At each load step, the tool advances to a new position, causing boundary condition updates for the contacting nodes. There are two kinds of contacting nodes. Nodes contacting the punch/die surface are called contact nodes, whereas nodes inside the binder contacting the upper binder ring and the lower binder surface on the die are called binder nodes.

At each load step, the computer searches for new nodal positions which satisfy the new boundary conditions and produce balanced internal forces and external forces, the spring and friction forces, at all nodes to model the drawbead, i.e. until equilibrium is reached. These load steps are continued until the tool. is advanced to its final position, and the automotive body panel has been formed. The search for new nodal positions is performed iteratively, with each iteration preferably producing a better result with a smaller unbalanced force. When the unbalanced force is small enough, the next load step begins and generates new boundary positions again. At each load step during the analysis, the predicted stress and deformation can be viewed to check defects such as potential permanent buckling and/or wrinkling.

The computer is then provided with data including the tool surface triangular mesh and the modified binder wrap triangular mesh. Additional control parameters, such as tolerances are also provided. Variables are initialized to predetermined and/or default values.

As an example, the tool is advanced an incremental amount, such as 1 mm. As the tool advances, the tool surface contacts the sheet metal. The computer then determines the contact nodes between the tool surface mesh and the sheet metal mesh by measuring the penetration of sheet metal nodes into the tool surface. This penetration gives rise to a boundary condition which enforces a displacement increment on the contact nodes, forcing them to the tool surface.

The material matricies, i.e. the stress-strain relationships, are established/updated so as to ensure accuracy. To form a complex body panel, there may be stress unloading in the panel even before the tool reaches the final position. Before the stress stage can be determined, at a sampling point in the sheet detected under an unloading condition, the pure elastic incremental material matrix is used, the determination of which is fully described in a paper entitled "Sheet Metal Forming Modeling of Automobile Body Panels" by S. C. Tang, J. Gress and P. Ling, published in 1988 by ASM International at the Controlling Sheet Metal Forming Processes $15^{th}$ Biannual Congress, which is hereby expressly incorporated by reference in its entirety.

Figure 6:
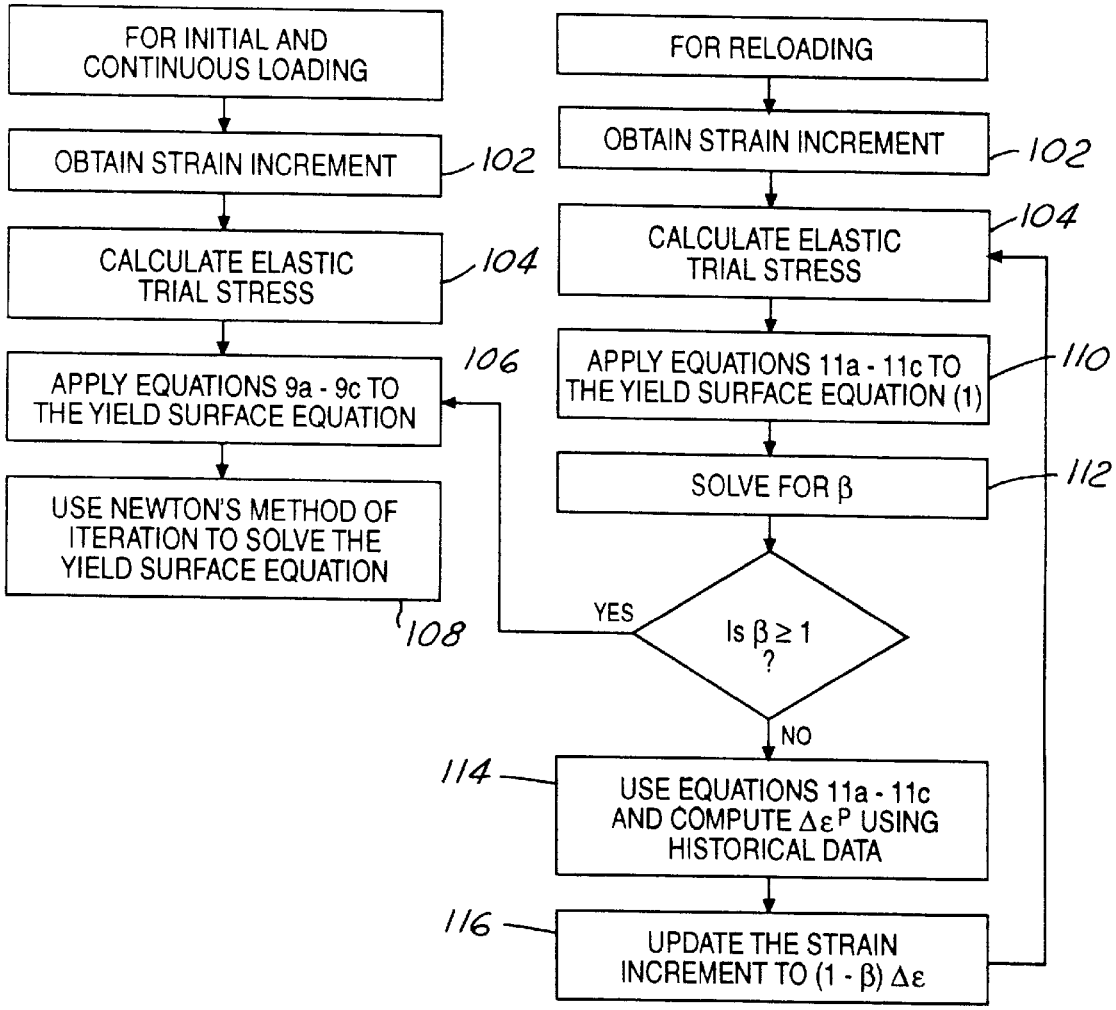
FIG. 6 is a flow chart detailing the steps for the method of the present invention.

Referring to FIG. 6, there is shown a flow chart representation of the method 100 of the present invention. Once the displacement increment is solved utilizing a tangent stiffness matrix mentioned in the paper and explained in greater detail below, the strain increment at that sampling point is obtained 102.

The total stress is then computed 104–116 using the radial return method applied to Mroz's anisotropic hardening rule of plasticity as set forth in this invention. If the computed equivalent stress increment is negative, the stress data at that point is under unloading, and the stress increment is preferably computed by the pure elastic incremental stress-strain relationship.

Accordingly, under this invention, the stress is calculated based on applying the radial return method to the anisotropic hardening rule of plasticity to compute the total stress after detecting reloading following unloading. This anisotropic hardening rule determines reloading. After reloading, the stresses are computed by the given strain increment following the method of the present invention.

It is convenient to use a rectangular coordinate system in the stress space to apply the radial return method to update the stress vector tensor. Following Chu's generalization and taking care of the transversely anisotropic property, Hill's yield surface, f, for the plane stress state is modified for the anisotropic hardening rule as follows:

$$f \equiv r_x^2 + r_y^2 - \alpha_1 r_x r_y + \alpha_2 r_{xy}^2 - k^2 \equiv (1-\alpha_1/2)(r_x+r_y)^2/2 + (1+\alpha_1/2)(r_x-r_y)^2/2 + \alpha_2 r_{xy}^2 - k^2 = 0 \quad (1)$$

where $\alpha_1 = 2R/(1+R)$ and $\alpha_2 = 2(1+2R)/(1+R)$. R is the transversely anisotropic material parameter and k is the flow stress at the effective plastic strain $\epsilon^p$ from the uni-axial tensile test.

In Equation (1), $$r_i = \sigma_i - a_i,\ i = x, y, xy$$

where $\sigma^i$ is a stress vector and $a_i$ is a position vector of the center of the yield surface (a back stress vector). It should be noted that for coding in finite element method, a vector instead of a tensor is used in the derivation. A boldface character denotes a vector.

Figure 1:
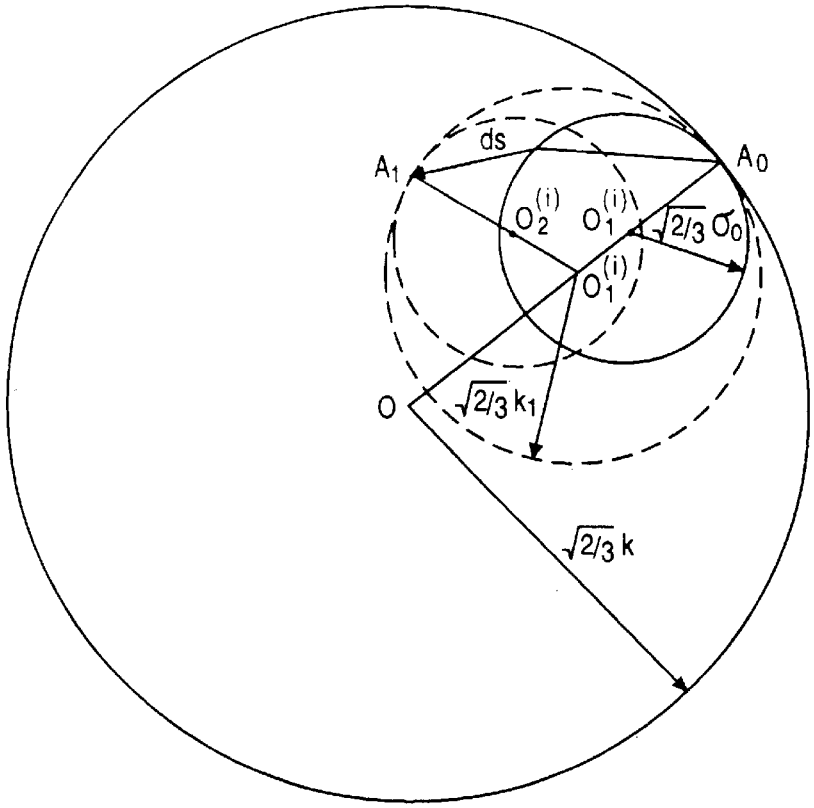
(PRIOR ART) FIG. 1
FIG. 1 is a graph showing the application of the anisotropic hardening rule for the transversely anisotropic material parameter R=1, yield surfaces in the deviatoric stress space during loading, unloading and reloading.

The movement of the center of the yield surface is expressed by:

$$\Delta a_i = A\Delta k b_i \quad (2)$$

where $\Delta$ denotes the increment, $b_i$ is a unit vector along which the center of the active yield surface moves, and A is a constant to be determined by $b_i$. Note that $a_i$ is a zero vector (the center is in the origin of the stress space) during initially and continuously loading before any unloading. As soon as there is unloading, $a_i$ becomes a finite vector and is determined by $b_i$ and the intial yield stress (similar to that shown in FIG. 1). For reloading, $a_i$ is computed incrementally by Equation (2).

The total strain increment is composed by the elastic and the plastic strain increments:

$$\Delta\epsilon_i = \Delta\epsilon_i^e + \Delta\epsilon_i^p \quad (3)$$

$$\Delta\sigma = H\Delta\epsilon^e \quad (4)$$

where H is the elasticity matrix.

$$\Delta\epsilon_i^p = \Delta\Lambda\partial f/\partial\sigma_i \quad (5)$$

where $\Delta\Lambda = \Delta\epsilon^p/2k$.

$$\Delta\sigma = H(\Delta\epsilon - \Delta\Lambda\partial f/\partial\sigma) \quad (6)$$

Adding $\sigma_0$ to both sides of equation 6 yields:

$$\sigma = \sigma^E - \Delta\Lambda H\partial f/\partial\sigma \quad (7)$$

where $\sigma^E$ is the elastic trial stress vector and $\sigma^E = \sigma_0 + H\Delta\epsilon$, $\sigma_0$ is the stress vector before being updated.

For initial loading, the center is at the origin ($a_i = 0$). For continuous loading, if the center of the active yield surface does not move to the oppostie side of the unit vector $b_i$ stored in the history file and movement of the center is still along the direction of the unit vector $b_i$, it can be assumed that there is no break in the yield surface. The following equations apply:

$$r = r^E - \Delta\Lambda H\partial f/\partial\sigma, \text{ where } r^E = \sigma^E - a \quad (8)$$

$$r_x + r_y = (r_x^E + r_y^E)/[1 + E\Delta\Lambda(2-\sigma_1)/(1-\nu)] \quad (9a)$$

$$r_x - r_y = (r_x^E - r_y^E)/[1 + E\Delta\Lambda(2+\sigma_1)/(1+\nu)] \quad (9b)$$

$$r_{xy} = r_{xy}^E/[1 + E\Delta\Lambda\alpha_2/(1+\nu)] \quad (9c)$$

where E is Young's modulus and v is Poisson's ratio.

When there is no break in the previous yield surface, the method of the present invention uses calculations that differ from the scenario when a break occurs. For the absence of an abrupt change in $b_i$ (i.e., $\beta \geqq 1$, which is explained hereinafter in Equation (10)), inserting 106 equations (9a), (9b), and (9c) into equation (1) yields an equation with only one unknown, $\Delta\epsilon^P$. Differentiate that equation with respect to $\Delta\epsilon^P$ and the derivative also has only one unknown, $\Delta\epsilon^P$, since, $$d\Delta\Lambda/d\epsilon^P=(1-k'\Delta\epsilon^P/k)/2k$$

k' is the differentiation of k with respect to $\epsilon^P$ and $da/d\epsilon^P=Ak'b$.

Since f and its derivative with respect to $\epsilon^P$ involve only one unknown $\Delta\epsilon^P$, $\Delta\epsilon^P$ can be solved 108 by Newton's method of iteration, if the derivative is not zero.

After the initial loading, unloading and reloading for a few cycles, there are a few yield surfaces with different unit vectors $b_i$ stored in a history file. For continuous reloading after a few cycles, if the center of the active yield surface moves to the opposite side of the unit vector $b_i$ stored in the history file, break of the current active yield surface occurs. The unit vector $b_i$ stored from the history file will be retrieved and becomes active, therefore, there is an abrupt change of $b_i$ in Equation (2). The presence or absence of a break will determine which equations (9a–9c or 11a–11c) apply.

A factor β is computed such that the strain increment $\beta\Delta\epsilon$ will generate the stress vector breaking the previous yield surface in the history file.

$$\sigma^E=\sigma_J+\beta H\Delta F\epsilon,\ \Delta\sigma^E=\beta H\Delta\epsilon \tag{10}$$

$$r_x^E+r_y^E=[(\sigma_{0x}-a_x)+(\sigma_{0y}-a_y)]+\beta(\Delta\sigma_x^E+\Delta\sigma_y^E) \tag{11a}$$

$$r_x^E-r_y^E=[(\sigma_{0x}-a_x)-(\sigma_{0y}-a_y)]+\beta(\Delta\sigma_x^E-\Delta\sigma_y^E) \tag{11b}$$

$$r_{xy}^E=(\sigma_{0xy-axy})+\beta\Delta\sigma_{xy}^E \tag{11c}$$

Inserting 110 equations (11a), (11b), and (11c) into Equation (9) and then into Equation (1) yields a quadratic equation of β. Note that $\Delta\epsilon^P$ and k are retrieved from the history file because they are stored in the history file before the unit vector $b_i$ changes its direction. Consequently, ΔΛ can be computed. Solving for β 112, if a root of β is greater than one, there is no break in the yield surface. If β is between 0 and 1, there is a break of the previous yield surface. If β is less than zero, there is an error.

For β<1, equations (11a), (11b), and (11c) applied 110 to equation (1) will provide a solution for β that makes it possible to that a break in the previous yield surface occurred. At this point, it is necessary to determine 114 where the break occurs. Using information taken from the history file, the unit vector $b_i$ can be updated. The strain increment is updated 116 to $(1-\beta)\Delta\epsilon$ and the method is repeated until $\beta\geqq 1$.

For β>1, equations (9a), (9b), and (9c) are applied 106 to equation (1) according to the present invention and solved as discussed above by Newton's method of iteration.

It is possible to expedite the convergence of Newton's iteration by estimating the value of $\Delta\epsilon^P$. Given $r_0$, $\epsilon_0$, and $\epsilon_0^P$ and the increment of the total strain vector $\Delta\epsilon$, $\Delta\epsilon^P$ can be estimated by:

$$\sigma_{0e}=(r_{0x}^2+r_{0y}^2-\Delta_1 r_{0x}r_{0y}+\alpha_2 r_{0xy}^2)^{1/2} \tag{12}$$

$$\Delta\epsilon=\alpha_3(\Delta\epsilon_x^2+\Delta\epsilon_y^2+\alpha_1\Delta\epsilon_x\Delta\epsilon_y+\alpha_1\Delta\epsilon_{xy}^2/4R)^{1/2} \tag{13}$$

where $\alpha_3=(1+R)/(1+2R)^{1/2}$ $$\epsilon=\epsilon_0+\Delta\epsilon=(\sigma_{0e}/E+\epsilon_0^P)+\Delta\epsilon \tag{14}$$

From the uni-axial stress-strain relationship;

$$\sigma=K\epsilon^n \tag{15}$$

since $$\epsilon^e=\sigma/E \tag{16}$$

and $$\epsilon^P=\epsilon-\epsilon^e \tag{17}$$

Thus, the invention covers all alternatives, modifications, and equivalents, as may be included within the spirit and scope of the appended claims.

What is claimed is:

1. A method for predicting deformation of a sheet of metal during a draw forming process designed to form the sheet metal into a part, said method for use with a computer having a memory and sheet forming tools, said method comprising the steps of:

obtaining a strain increment, Δε, for a load step associated with initial loading, unloading and reloading without a break in the yield surface of the sheet metal in the sheet forming tools;

calculating the total stress for the strain increment by Mroz's hardening rule according to the following yield surface equation;

$$f\equiv r_x^2+r_y^2-\alpha_1 r_x r_y+\alpha_2 r_{xy}^2-k^2\equiv(1-\alpha_1/2)(r_x+r_y)^2/2+(1+\alpha_1/2)\ (r_x-r_y)^2/2+\alpha_2 r_{xy}^2-k^2=0$$

where $\alpha_1=2R/(1+R)$ and $\alpha_2=2(1+2R)/(1+R)$, $$r_i=\sigma_i-a_i,\ i=x,\ y,\ xy$$

$$\Delta a_i=A\Delta k b_i$$

$$\Delta\epsilon_i=\Delta\epsilon_i^e+\Delta\epsilon_i^P$$

$$\Delta\sigma=H\Delta\epsilon^e$$

$$\Delta\epsilon_i^P=\Delta\Lambda\partial f/\partial\sigma_i$$

where $\Delta\Lambda=\Delta\epsilon^P/2k$ $$\Delta\sigma=H(\Delta\epsilon-\Delta\Lambda\partial f/\partial\sigma)$$

$$\sigma=\sigma^E-\Delta\Lambda H\partial f/\partial\sigma$$

where $\sigma^E$ is the elastic trial stress vector and $\sigma^E=\sigma_0+H\Delta\epsilon$ $$r=r^E-\Delta\Lambda H\partial f/\partial\sigma,\ \text{where}\ r^E=\sigma^E-a$$

applying the radial return method to the yield surface equation according to the following equations:

$$r_x+r_y=(r_x^E+r_y^E)/[1+E\Delta\Lambda(2-\alpha_1)/(1-\nu)] \tag{9a}$$

$$r_x-r_y=(r_x^E-r_y^E)/[1+E\Delta\Lambda(2+\alpha_1)/(1+\nu)] \tag{9b}$$

$$r_{xy}=r_{xy}^E/[1+E\Delta\Lambda\alpha_2/(1+\nu)] \tag{9c}$$

where E=Young's mnodulus

ν=Poisson's ratio $\Delta\Lambda=\Delta\epsilon^P/2Y$ solving the yield surface equation by using Newton's method of iteration;

obtaining a strain increment, Δε, for a load step associated with reloading with a possible break in the yield surface of the sheet metal in the sheet forming tools;

calculating the total stress for the strain increment by Mroz's hardening rule according to the following yield surface equation:

$$f=r_x^2+r_y^2-\alpha_1 r_x r_y+\alpha_2 r_{xy}^2-k^2=(1-\alpha_1/2)(r_x+r_y)^2/2+(1+\alpha_1/2)(r_x-r_y)^2/2+\alpha_2 r_{xy}^2-k^2=0$$

where $\alpha_1=2R/(1+R)$ and $\alpha_2=2(1+2R)/(1+R)$, $$r_i=\sigma_i-a_i,\ i=x,\ y,\ xy$$

$$\Delta a_i=A\Delta k b_i$$

$$\Delta\epsilon_i=\Delta\epsilon_i^e+\Delta\epsilon_i^p$$

$$\Delta\sigma=H\Delta\epsilon^e$$

applying the radial return method to the yield surface equation according to the following equations:

$$r_x^E+r_y^E=[(\sigma_{0x}-a_x)+(\sigma_{0y}-a_y)]+\beta(\Delta\sigma_x^E+\Delta\sigma_y^E)$$

$$r_x^E-r_y^E=[(\sigma_{0x}-a_x)-(\sigma_{0y}-a_y)]+\beta(\Delta\sigma_x^E-\Delta\sigma_y^E)$$

$$r_{xy}^E=(\sigma_{0xy-axy})+\beta\Delta\sigma_{xy}^E;$$

solving the yield surface equation for $\beta$, whereby for $\beta<1$, existing data is used to determine the total stress and reset the strain increment;

repeat the step of calculating the total stress for the strain increment using Mroz's hardening rule until $\beta\geqq 1$; and for $\beta\geqq 1$, the following equations are applied to the yield surface equation and the yield surface equation is solved using Newton's method of iteration:

$$r_x+r_y=(r_x^E+r_y^E)/[1+E\Delta\Lambda(2-\alpha_1)/(1-\nu)]$$

$$r_x-r_y=(r_x^E-r_y^E)/[1+E\Delta\Lambda(2+\alpha_1)/(1+\nu)]$$

$$r_{xy}=r_{xy}^E/[1+E\Delta\Lambda\alpha_2/(1+\nu)]$$

$$(1-\alpha_1/2)(r_x+r_y)^2/2+(1+\alpha_1/2)(r_x-r_y)^2/2+\alpha_2 r_{xy}^2-k^2=0.$$

2. The method as set forth in claim 1 wherein said step of determining the presence of a break in the previous yield surface further comprises the steps of:

applying the following equations to the yield surface equation:

$$r_x^E+r_x^E=[(\sigma_{0x}-a_x)+(\sigma_{0y}-a_y)]+\beta(\Delta\sigma_x^E+\Delta\sigma_y^E)$$

$$r_x^E-r_y^E=[(\sigma_{0x}-a_x)-(\sigma_{0y}-a_y)]+\beta(\Delta\sigma_x^E-\Delta\sigma_y^E)$$

$$r_{xy}^E=(\sigma_{0xy-axy})+\beta\Delta\sigma_{xy}^E;\text{ and}$$

solving the yield surface equation for $\beta$.

3. The method as set forth in claim 2 wherein said step of applying the appropriate equations further comprises:

determining $\beta<1$; and usig historical data to determine the total stress.

4. The method as set forth in claim 1 wherein said step of solving the yield surface equation by using Newton's method of iteration further comprises the step of estimating $\Delta\epsilon^p$.

5. The method as set forth in claim 4 wherein said step of estimating $\Delta\epsilon^p$ finher comprises:

$$\sigma_{0e}=(r_{0x}^2+r_{0y}^2-\alpha_1 r_{0x} r_{0y}+\alpha_2 r_{0xy}^2)^{1/2}$$

$$\Delta\epsilon=\alpha_3(\Delta\epsilon_x^2+\Delta\epsilon_y^2+\alpha_1\Delta\epsilon_x\Delta\epsilon_y+\alpha_1\Delta\epsilon_{xy}^2/4R)^{1/2}$$

where $\alpha_3=(1+R)/(1+2R)^{1/2}$ $$\epsilon=\epsilon_0+\Delta\epsilon=(\sigma_{0e}/E+\epsilon_0^p)+\Delta\epsilon;$$

where from the uni-axial stress-strain relationship;

$$\sigma=K\epsilon^n,\text{ since}$$

$$\epsilon^e=\sigma/E,\text{ and}$$

$$\epsilon^p=\epsilon-\epsilon^e.$$

* * * * *